US010144613B2

(12) United States Patent
Mochizuki et al.

(10) Patent No.: US 10,144,613 B2
(45) Date of Patent: Dec. 4, 2018

(54) ELEVATOR POSITION DETECTION APPARATUS

(71) Applicant: MITSUBISHI ELECTRIC CORPORATION, Chiyoda-ku (JP)

(72) Inventors: Keita Mochizuki, Chiyoda-ku (JP); Jin Inoue, Chiyoda-ku (JP); Akihide Shiratsuki, Chiyoda-ku (JP); Hiroshi Taguchi, Chiyoda-ku (JP); Masahiro Ishikawa, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 0 days.

(21) Appl. No.: 15/305,042

(22) PCT Filed: May 21, 2014

(86) PCT No.: PCT/JP2014/063456

§ 371 (c)(1),
(2) Date: Oct. 18, 2016

(87) PCT Pub. No.: WO2015/177885

PCT Pub. Date: Nov. 26, 2015

(65) Prior Publication Data

US 2017/0137257 A1 May 18, 2017

(51) Int. Cl.
*B66B 1/36* (2006.01)
*B66B 3/02* (2006.01)
(Continued)

(52) U.S. Cl.
CPC ..... *B66B 5/0018* (2013.01); *B66B 1/36* (2013.01); *B66B 9/00* (2013.01)

(58) Field of Classification Search
CPC ..... B66B 1/3492; B66B 5/0018; B66B 3/02; B66B 5/16; B61L 2210/04
See application file for complete search history.

(56) References Cited

U.S. PATENT DOCUMENTS 4,433,756 A 2/1984 Caputo et al.
5,693,919 A * 12/1997 Sager ..... B66B 5/027 187/282
(Continued)

FOREIGN PATENT DOCUMENTS

CN 102020150 A 4/2011
JP 8-123889 A 5/1996
(Continued)

OTHER PUBLICATIONS

International Search Report dated Aug. 12, 2014 in PCT/JP2014/063456 Filed May 21, 2014.
(Continued)

*Primary Examiner* — Marlon Fletcher
(74) *Attorney, Agent, or Firm* — Xsensus, LLP

(57) ABSTRACT

A detection subject body provided in a hoistway includes an ID sequence formed by arranging three or more types of segments having different magnetic properties in a movement direction of an elevating body. An eddy current type detection unit is provided on the elevating body to generate signals corresponding to the magnetic properties of the respective segments. An identification unit identifies the respective types of the segments on the basis of the signals from the detection unit, and outputs a time series signal in a different output condition depending on the type of each segment. A digital data conversion unit converts the time series signal into digital data on the basis of variations in the output condition of the time series signal from the identification unit. A position specification unit specifies the position of the elevating body on the basis of the digital data.

11 Claims, 9 Drawing Sheets

(51) Int. Cl.
*B66B 5/00* (2006.01)
*B66B 9/00* (2006.01)

(56) References Cited

U.S. PATENT DOCUMENTS

| | | | | |
|---|---|---|---|---|
| 9,837,860 | B2 * | 12/2017 | McCarthy | B66B 1/34 |
| 2004/0070285 | A1 * | 4/2004 | Sogard | H02K 41/03 310/12.25 |
| 2006/0278478 | A1 * | 12/2006 | Pribonic | B61H 7/083 188/159 |
| 2007/0029141 | A1 * | 2/2007 | Chida | B66B 5/0031 187/393 |
| 2007/0056806 | A1 * | 3/2007 | Okamoto | B66B 5/06 187/290 |
| 2007/0062763 | A1 * | 3/2007 | Shiratsuki | B66B 1/3492 187/394 |
| 2007/0089938 | A1 * | 4/2007 | Ishioka | B66B 5/18 187/391 |
| 2007/0125604 | A1 * | 6/2007 | Ohira | B66B 1/34 187/391 |
| 2010/0026562 | A1 | 2/2010 | Hyodo et al. | |
| 2015/0263577 | A1 * | 9/2015 | Aaltonen | H02K 21/12 318/16 |
| 2015/0314984 | A1 * | 11/2015 | McCarthy | H02J 7/025 187/413 |
| 2017/0066625 | A1 * | 3/2017 | Shiratsuki | B66B 1/3492 |
| 2017/0137257 | A1 * | 5/2017 | Mochizuki | B66B 5/0018 |
| 2017/0279311 | A1 * | 9/2017 | Hanabusa | H02J 50/90 |
| 2017/0355555 | A1 * | 12/2017 | Ginsberg | B66B 1/3453 |
| 2018/0009630 | A1 * | 1/2018 | Depaola, Jr. | B66B 1/30 |

FOREIGN PATENT DOCUMENTS

| | | | | |
|---|---|---|---|---|
| JP | 2788361 | B2 | 6/1998 | |
| JP | 2004-67252 | A | 3/2004 | |
| JP | 2010-38607 | A | 2/2010 | |
| JP | 2011-63435 | A | 3/2011 | |
| JP | 2012-66881 | A | 4/2012 | |
| JP | WO 2015177885 | A1 * | 11/2015 | B66B 1/36 |
| WO | 2013/118317 | A1 | 8/2013 | |

OTHER PUBLICATIONS

Mar. 28, 2018 in corresponding Patent Application No. 201480078984.3 (with English Translation and English Translation of Category of Cited Documents) citing documents AA and AO therein, 13 pages.

* cited by examiner

ELEVATOR POSITION DETECTION APPARATUS

TECHNICAL FIELD

This invention relates to an elevator position detection apparatus for detecting a position ox an elevating body.

BACKGROUND ART

In an elevator car position correction apparatus known in the prior art, a slit pattern is provided in a landing position detection plate provided in a hoistway, and an absolute position of a car is detected by detecting the slit pattern using a landing detector provided on the car. The slit pattern is constituted by a combination of a plurality of slits, and different patterns are expressed by varying the respective widths of the slits and the number of slits (see PTL 1).

Further, in a car position detection apparatus proposed in the prior art, for the purpose of determining whether or not the car is in a door zone and whether or not the car is in a releveling zone, an identification plate formed by arranging three conductors in a movement direction of a car such that a conductor of one type is sandwiched between conductors of another type is provided in a hoistway, and the conductor in whose range the car is positioned is identified using a magnetic field generator and a magnetic field detector provided in the car. The magnetic field detector identifies the type of the conductor by detecting an amplitude and a phase of an eddy current magnetic field generated by the identification plate when a magnetic field is applied to the identification plate by the magnetic field generator (see PTL 2).

CITATION LIST

Patent Literature

[PTL 1]
Japanese Patent Application Publication No. H5-43159
[PTL 2]
WO 2013/118317

SUMMARY OF INVENTION

Technical Problem

However, in the conventional elevator position correction apparatus disclosed in PTL 1, when the speed of the car varies, it may become impossible to detect the widths of the slits accurately, and as a result, the position of the car may be detected erroneously.

Further, in the conventional elevator position detection apparatus disclosed in PTL 2, the position of the car is detected in accordance with the ranges of the respective conductors of the identification plate, and therefore the number of types of conductors must be increased in order to increase the number of car detection positions. As a result, a cost increase occurs.

This invention has been designed to solve the problems described above, and an object thereof is to obtain an elevator position detection apparatus with which a position of an elevating body within a hoistway can be detected more accurately while suppressing a cost increase.

Solution to Problem

An elevator position detection apparatus according to this invention includes: a detection subject body provided in a hoistway and provided with an ID sequence formed by arranging three or more types of segments respectively having different magnetic properties in a movement direction of an elevating body, wherein segments having a different magnetic property to a magnetic property of a space within the hoistway are disposed on respective ends of the ID sequence in the movement direction of the elevating body; an eddy current type detection unit provided in the elevating body in order to generate signals corresponding to the magnetic properties of the respective segments by applying a magnetic field to the ID sequence while passing through a position of the detection subject body; an identification unit that identifies the respective types of the segments on the basis of the signals from the detection unit, and outputs a time series signal in a different output condition depending on the type of each segment; a digital data conversion unit that converts the time series signal into digital data on the basis of variations in the output condition of the time series signal from the identification unit; and a position specification unit that specifies a position of the elevating body on the basis of the digital data from the digital data conversion unit.

Advantageous Effects of Invention

With the elevator position detection apparatus according to this invention, the position of the elevating body within the hoistway can be detected more accurately while suppressing a cost increase.

DESCRIPTION OF EMBODIMENTS

Preferred embodiments of this invention will be described below with reference to the drawings.

First Embodiment

Figure 1:
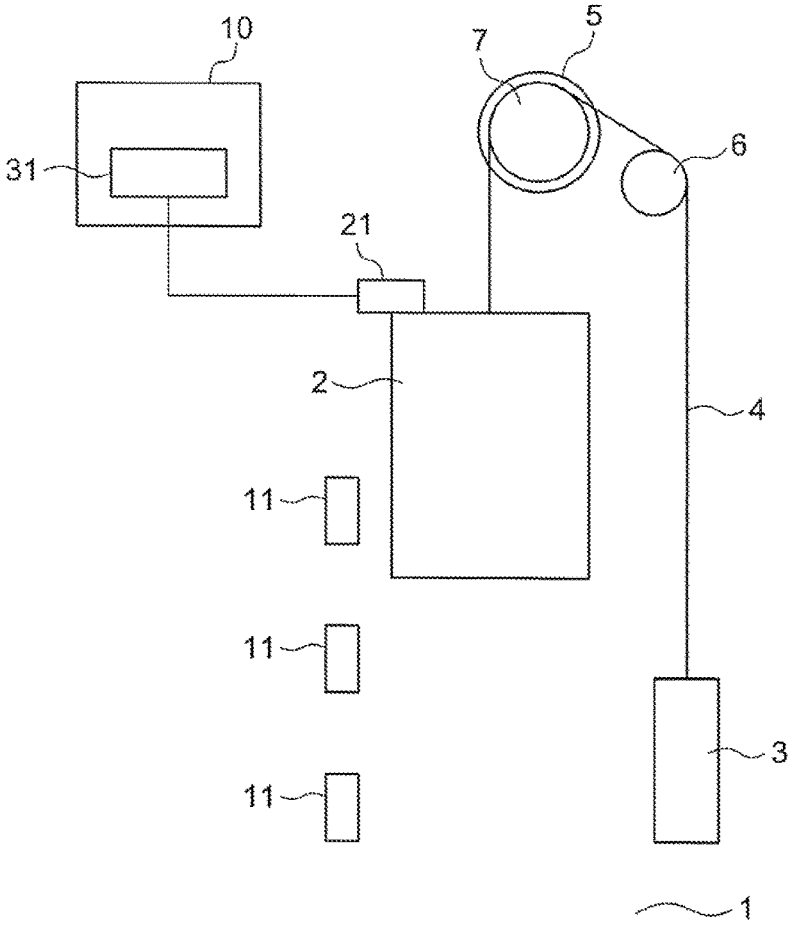
FIG. 1 is a view showing a configuration of an elevator according to a first embodiment of this invention.

FIG. 1 is a view showing a configuration of an elevator according to a first embodiment of this invention. In the drawing, a car (an elevating body) 2 and a counter weight 3 are suspended from a main cable 4 within a hoistway 1. A rope, a belt, or the like, for example, is used as the main cable 4.

A hoisting machine (a driving apparatus) 5 and a deflector sheave 6 are provided in an upper portion of the hoistway 1. The hoisting machine 5 generates driving force for moving the car 2 and the counter weight 3 in a vertical direction. Further, the hoisting machine 5 includes a drive sheave 7. The main cable 4 is wound around the drive sheave 7 and the deflector sheave 6. The drive sheave 7 is rotated by driving force from the hoisting machine 5, and as a result, the car 2 and the counter weight 3 are moved through the hoistway 1 in the vertical direction.

A plurality of detection subject bodies 11 are fixed within the hoistway 1. The detection subject bodies 11 are disposed respectively in a plurality of reference positions set at intervals from each other in a movement direction of the car 2. In this example, positions corresponding to respective floors are set as the reference positions.

A detector 21 that detects the detection subject bodies 11 is provided on an upper portion of the car 2. A signal from the detector 21 is transmitted to a control apparatus 10 that controls an operation of the elevator. The control apparatus 10 is provided with a position specification unit 31 that specifies the position of the car 2 by processing the signal from the detector 21. The control apparatus 10 controls the operation of the elevator on the basis of the position of the car 2, specified by the position specification unit 31. The elevator position detection apparatus includes the plurality of detection subject bodies 11, the detector 21, and the position specification unit 31.

Figure 2:
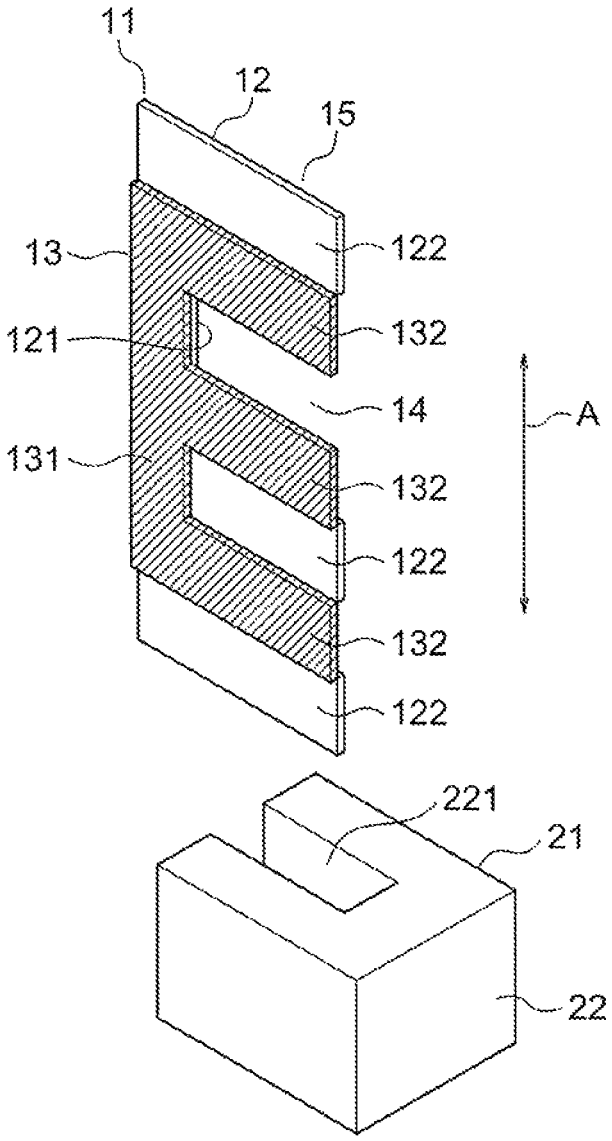
FIG. 2 is a perspective view showing a detection subject body and a detector shown in FIG. 1.

FIG. 2 is a perspective view showing the detection subject body 11 and the detector 21 shown in FIG. 1. The detection subject body 11 is formed by combining a first plate 12 constituted by a first conductor (in this example, stainless steel), and a second plate 13 constituted by a second conductor (in this example, aluminum) that has a different magnetic property to the first conductor. In other words, the detection subject body 11 is formed by combining the first and second plates 12, 13 constituted by different types of conductors. As a result, the first and second places 12, 13 have different resistivity and permeability values.

The first plate 12 includes a first connecting plate portion 121 that extends in the movement direction of the car 2, and a plurality of first detection subject plate portions 122 that project from a side portion of the first connecting plate portion 121 in a direction that intersects the movement direction of the car 2. The second plate 13 includes a second connecting plate portion 131 that extends in the movement direction of the car 2, and a plurality of second detection subject plate portions 132 that project from a side portion of the second connecting plate portions 131 in a direction that intersects the movement direction of the car 2. The first and second plates 12, 13 are combined by overlapping the first and second connecting plate portions 121, 131 in a condition where the first and second detection subject plate portions 122, 132 are arranged in the movement direction of the car 2 such that space portions 14 are formed selectively. As a result, the detection subject body 11 is provided with an ID sequence 15 that is obtained by arranging the first detection subject plate portions 122, the second detection subject plate portions 132, and the space portions 14 in the movement direction of the car 2 so as to form N (where N is a natural number no smaller than three) segments. In this example, the number of segments of the ID sequence 15 provided in each detection subject body 11 is set at seven.

The first conductor serving as the material forming the first detection subject plate portions 122, the second detector serving as the material forming the second detection subject plate portions 132, and air existing in the space portions 14 all have different magnetic properties. In other words, the ID sequence 15 is formed by arranging three types of segments (the first, detection subject plate portions 122, the second detection subject plate portions 132 and the space portions 14) having different magnetic properties in the movement direction of the car 2. As a result, the three types of segments (the first detection subject plate portions 122, the second detection subject plate portions 132, and the space portions 14) generate different eddy current magnetic fields in response to magnetic field application.

An arrangement combination (an arrangement pattern) of the first detection subject plate portions 122, the second detection subject plate portions 132, and the space portions 14 (the segments) forming the ID sequence 15 differs in each reference position within the hoistway 1. In other words, the first detection subject plate portions 122, the second detection subject plate portions 132, and the space portions 14 (the segments) are arranged in the ID sequences 15 in arrangement combinations that correspond individually to the respective reference positions within the hoistway 1. As a result, the position of the detection subject body 11 within the hoistway 1 can be specified individually from the arrangement combination of the ID sequence 15. In other words, position information for specifying the position of the detection subject body 11 within the hoistway 1 is set in each detection subject body 11 by means of the arrangement combination of the ID sequence 15.

Figure 3:
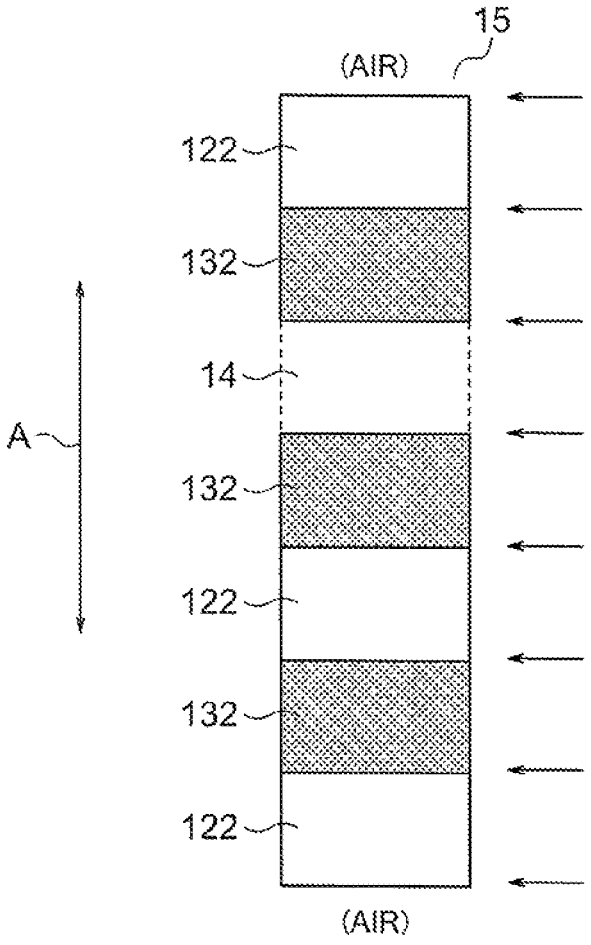
FIG. 3 is a schematic view showing a configuration of an ID sequence of the detection subject body shown in FIG. 2.

FIG. 3 is a schematic view showing a configuration of the ID sequence of the detection subject body 11 shown in FIG. 2. In each detection subject body 11, a segment having a different magnetic property to the magnetic property of a space within the hoistway 1 (i.e. air) is disposed on each end of the ID sequence 15 in the movement direction of the car 2. Hence, the segments of the ID sequence 15 are arranged in each detection subject body 11 so as to avoid disposing the space portion 14 on the respective ends of the ID sequence 15 in the movement direction of the car 2. Further, the first detection subject plate portions 122, the second detection subject plate portions 132, and the space portions 14 (the segments) are arranged in each ID sequence 15 so that adjacent segments have different magnetic properties.

Note that FIG. 3 shows the ID sequence 15 corresponding to one of the reference positions. In the ID sequence 15 shown in FIG. 3, the segments are arranged in order of the first detection subject plate portion 122, the second detection subject plate portion 132, the space portion 14, the second detection subject plate portion 132, the first detection subject plate portion 122, the second detection subject plate portion 132, and the first detection subject plate portion 122 in descending order from an upper end of the ID sequence 15.

Figure 4:
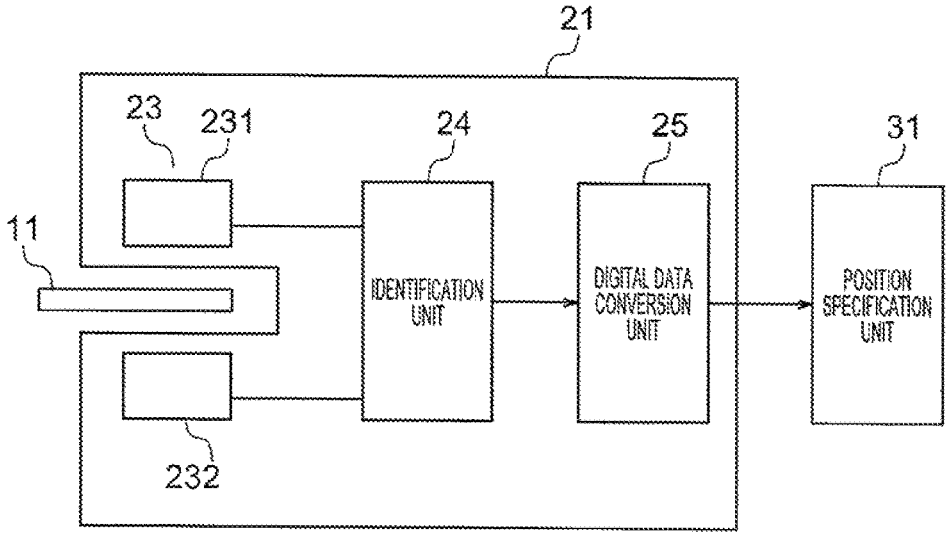
FIG. 4 is a block diagram showing an elevator position detection apparatus shown in FIG. 1.

FIG. 4 is a block diagram showing the elevator position detection apparatus shown in FIG. 1. As shown in FIGS. 2 and 4, the detector 21 includes a support unit (a casing) 22 fixed to the car 2, and a detection unit 23, an identification unit 24, and a digital data conversion unit 25 provided respectively on the support unit 22.

As shown in FIG. 2, a detection groove 221 is provided in the support unit 22 so as to extend in the movement direction of the car 2. The ID sequence 15 of the detection subject body 11 is disposed in the detection groove 221 when seen from the movement direction of the car 2. Hence, when the detector 21 moves together with the car 2 so that the detector 21 passes through the positions of the respective detection subject bodies 11, the ID sequences 15 of the detection subject bodies 11 pass through the detection groove 221.

As shown in. FIG. 4, the detection unit 23 is an eddy current type detection unit including a magnetic field generation coil (a magnetic field generation unit) 231 and a magnetic field detection coil (a magnetic field detection unit) 232. The magnetic field generation coil 231 and the magnetic field detection coil 232 are provided on the support unit 22 so as to oppose each other on either side of the detection groove 221.

When energized, the magnetic field generation coil 231 forms a high frequency magnetic field in a detection region set in the detection groove 221. When the ID sequence 15 passes through the detection region in the detection groove 221, the high frequency magnetic field formed by the magnetic field generation coil 231 is applied to the ID sequence 15 such that eddy currents corresponding to the respective segments are generated on the ID sequence 15, and as a result, eddy current magnetic fields corresponding to the respective segments are generated from the ID sequence 15.

The magnetic field detection coil 232 detects the eddy current magnetic fields generated from the ID sequence 15 when the high frequency magnetic field is exerted on the detection region within the detection groove 221, and generates signals corresponding to the magnetic properties of the respective segments of the ID sequence 15. The signals from the magnetic field detection coil 232 are transmitted to the identification unit 24.

The identification unit 24 identifies the segment types of the three types of segments, namely the first detection subject plate portion 122, the second detection subject plate portion 132, and the space portion 14, on the basis of the signals from the magnetic field detection coil 232. For example, the identification unit 24 identifies the segment types from amplitudes of the detected magnetic fields detected by the magnetic field detection coil 232 or phase differences between the applied magnetic field applied by the magnetic field generation coil 231 and the detected magnetic fields detected by the magnetic field detection ceil 232. Further, the identification unit 24 outputs a time series signal in a different output condition in accordance with the identified segment type. In this example, the time series signal is output at respectively different output levels in response to the space portion 14, the first detection subject plate portion 122, and the second detection subject plate portion 132.

Figure 5:
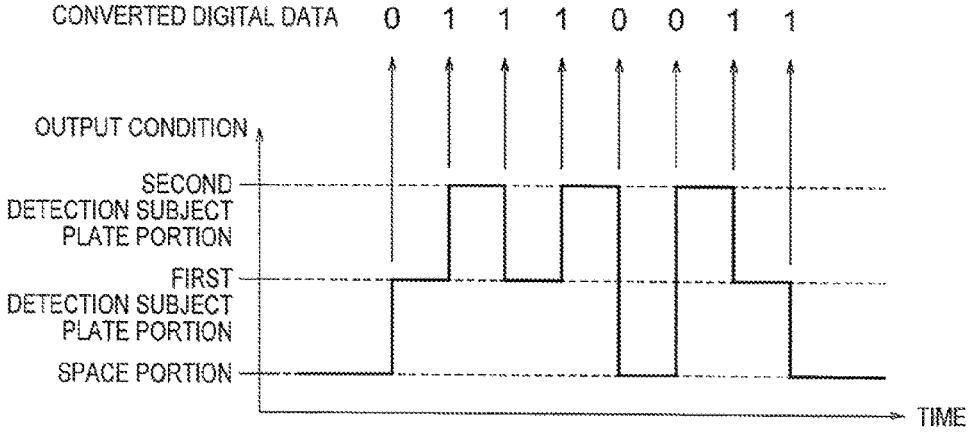
FIG. 5 is a graph showing temporal variation in a time series signal output by an identification unit when the detector passes through the position of the detection subject body shown in FIG. 2 while moving upward.

Here, FIG. 5 is a graph showing temporal variation in the time series signal output by the identification unit 24 when the detector 21 passes through the position of the detection subject body 11 shown in FIG. 2 while moving upward. When the car 2 moves upward so that the detector 21 passes through the position of the detection subject body 11 shown in FIG. 2, the detection subject body 11 passes through the detection region in the detection groove 221 from top to bottom. Accordingly, the identification unit 24 identifies the segment types in order of the space (air) in the hoistway 1, the first detection subject plate portion 122, the second detection subject plate portion 132, the first detection subject plate portion 122, the second detection subject plate portion 132, the space portion (air) 14, the second detection subject plate portion 132, the first detection subject plate portion 122, and the space (air) in the hoistway 1. As a result, the identification unit 24 outputs a time series signal having art output condition that varies on the boundaries between the air in the hoistway 1 and the ID sequence 15 and the boundaries between the respective segments, such as that shown in FIG. 5, to the digital data conversion unit 25.

The digital data conversion unit 25 converts the time series signal into digital data on the basis of the variations in the output condition of the time series signal from the identification unit 24. More specifically, the digital data conversion unit 25 converts the time series signal into digital data by allocating a digital value "1" or "0" to each position (switch position) in which the output condition of the time series signal from the identification unit 24 varies.

Figure 6:
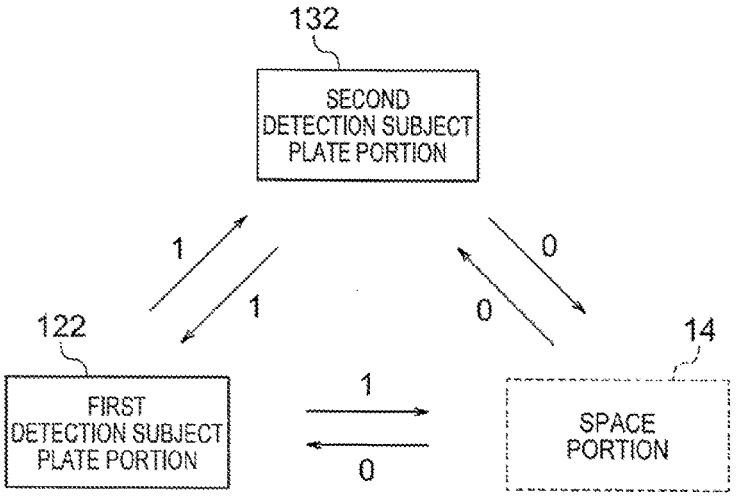
FIG. 6 is an illustrative view showing relationships between digital values and variations in an output condition of the time series signal shown in FIG. 5 between respective segments.

FIG. 6 is an illustrative view showing relationships between the digital values and the variations in the output condition of the time series signal shown in FIG. 5 between the respective segments. Note that in FIG. 6, directions of the variations in the output condition of the time series signal are indicated by arrows. In this example, the digital value "1" is allocated to all of the variations between the first detection subject plate portion 122 and the second detection subject plate portion 132, and the digital value "0" is allocated to all of the variations between the second detection subject plate portion 132 and the space portion 14 (including the air on the exterior of the ID sequence 15). Further, in this example, the digital value "1" is allocated to the variation from the first detection subject plate portion 122 to the space portion 14, and the digital value "0" is allocated to the variation from the space portion 14 to the first detection subject plate portion 122.

In the case of the time series signal shown in FIG. 5, for example, when the time series signal is converted into digital data by the digital data conversion unit 25 in accordance with the relationships between the digital values and the variations in the output condition shown in FIG. 6, 8-bit digital data consisting of "01110011" are obtained. In other words, digital data consisting of eight bits (N+1 bits) are obtained from the ID sequence 15 formed by arranging seven (N) segments, with the result that the number of bits is larger than the number of segments in the ID sequence 15 by one. The arrangement combination of the segments forming the ID sequence 15 differs in each detection subject body 11. Therefore, the digital data obtained from the ID sequence 15 of the detection subject body 11 also differ in each reference position. The digital data converted from the time series signal are output from the digital data conversion unit 25 to the position specification unit 31 as the position information for specifying the position of the car 2.

The position specification unit 31 specifies the position of the car 2 on the basis of the digital data from the digital data conversion unit 25. More specifically, a plurality of sets of digital data corresponding to the respective reference positions are stored in advance in the position specification unit 31 as set data, and by comparing the digital data from the digital data conversion unit 25 with the set data, the position specification unit 31 specifies the detection subject body 11 detected by the detector 21, and thereby specifies the position of the car 2 within the hoistway 1.

In this elevator position detection apparatus, the ID sequence 15 formed by arranging three types of segments having different magnetic properties is provided in the detection subject body 11 while the eddy current type detection unit 23 that generates signals corresponding to the magnetic properties of the respective segments is provided in the car 2, and therefore detection errors caused by dust, smoke, and so on, for example, can be prevented from occurring. Further, a time series signal is output by the identification unit 24 in a different output condition depending on the type of each segment, and the time series signal from the identification unit 24 is converted into digital data on the basis of the variations in the output condition of the time series signal. Therefore, variation in the conversion result obtained by converting the time series signal into digital data can be prevented from occurring even when the speed of the car 2 varies, for example. As a result, the position of the car 2 within the hoistway 1 can be detected more accurately. Furthermore, a digital value can be allocated to each variation in the output condition of the time series signal, and therefore digital data consisting of N+1 bits, which is larger than, the number N of segments in the ID sequence 15, can be obtained. Hence, the amount of information in the digital data used to specify the position of the car 2 can be increased without increasing the number of types of segments, and as a result, a cost increase can be suppressed.

Moreover, one of the types of segments disposed so as to avoid the respective ends of the ID sequence 15 is the space portion 14 formed from air, and therefore the space portion 14 can be incorporated into the ID sequence 15 as a segment. As a result, a segment that does not need to foe constituted by a conductor can be formed easily, enabling a reduction in cost.

Further, the different types of segments are constituted by different types of conductors, namely the first and second conductors, and therefore different types of segments can be provided easily simply by varying the type of conductor.

Note that in the example described above, the first and second detection subject plate portions 122, 132 may be provided with mutually different magnetic properties by employing different types of conductors to form the first, and second detection subject plate portions 122, 132, but instead, for example, the first and second detection subject plate portions 122, 132 may be provided with mutually different magnetic properties by forming the first and second detection subject plate portions 122, 132 at different plate thicknesses.

Further, in the example described above, the ID sequence 15 is formed by arranging the first and second detection subject plate portions 122, 132 of the combined first and second plates 12, 13 in the movement direction of the car 2, but the ID sequence 15 is not limited to this configuration, and instead, for example, an ID sequence may foe formed by providing metal plating (aluminum plating or the like, for example) of different thicknesses on an insulating plate so as to serve as the different types of segments.

Moreover, in the example described above, air exists in the space portion 14, but instead, for example, an insulating member may be provided in the space portion 14. Furthermore, an additional detection subject plate portion of a different type to the first and second detection subject plate portions 122, 132 may be disposed as a segment of the ID sequence 15 instead of the space portion 14. In this case, the additional detection subject plate portion is formed from a conductive material having a different magnetic property to the materials respectively forming the first and second detection subject plate portions 122, 132.

Second Embodiment

Figure 7:
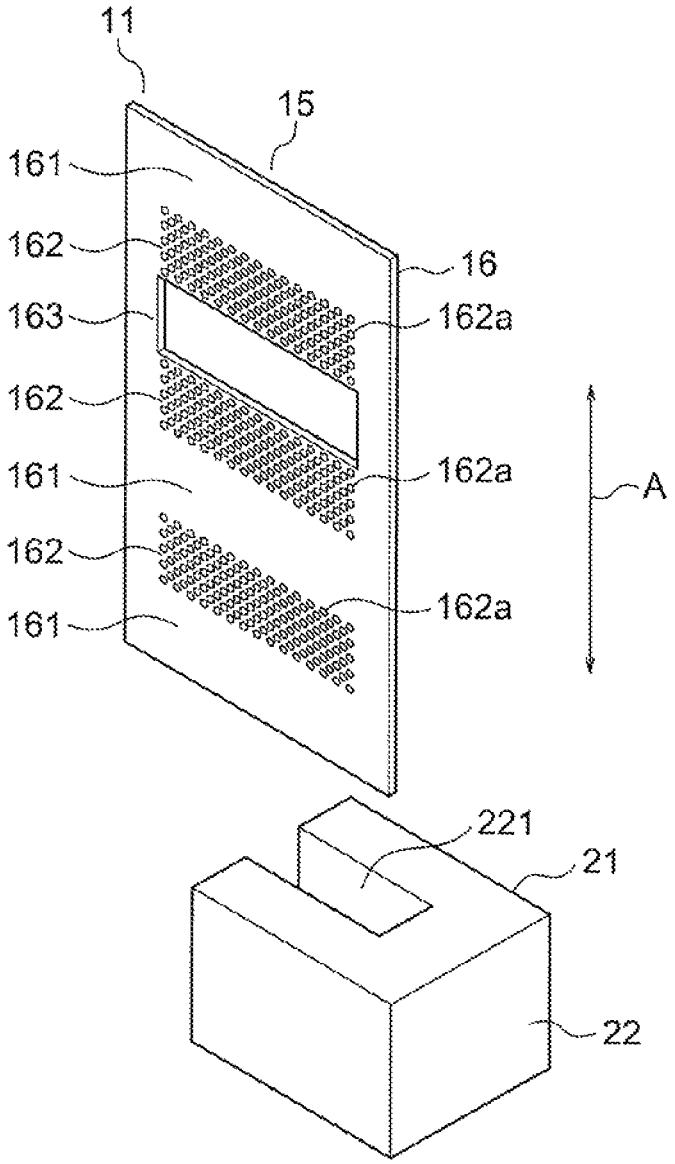
FIG. 7 is a perspective view showing a detection subject body and a detector of an elevator position detection apparatus according to a second embodiment of this invention.

FIG. 7 is a perspective view showing a detection subject body and a detector of an elevator position detection apparatus according to a second embodiment of this invention. The detection subject body 11 includes a detection subject plate (a base material) 16 formed from a single material (a conductor). The detection subject plate 16 is disposed in the movement direction of the car 2.

A plate portion 161 serving as a part constituted only by the material of the detection subject plate 16, a net portion 162 serving as a part of the detection subject plate 16 in which a plurality of holes 162*a* are formed, and an opening portion (a space portion) 163 constituted entirely by a space are formed in the detection subject plate 16 so as to be arranged in the movement direction of the car 2. Hence, the ID sequence 15 provided in the detection subject plate 16 is formed by arranging the plate portion 161, the net portion 162, and the opening portion 163 in the movement direction of the car 2 as N (where N is a natural number no smaller than 3) segments.

No spaces are formed in the plate portion 161, and therefore the magnetic property of plate portion 161 is different to the respective magnetic properties of the net portion 162 and the opening portion 163. Further, the respective magnetic properties of the net portion 162 and the opening portion 163 differ from each other due to a difference in the density of the spaces formed respectively in the net portion 162 and the opening portion 163. In other words, the ID sequence 15 is formed by arranging the plate portion 161, the net portion 162, and the opening portion 163 in the movement direction of the car 2 as segments of different types. All other configurations are identical to the first embodiment.

In this elevator position detection apparatus, an ID sequence is provided in the detection subject plate 16, which is formed from a single material, and the ID sequence 15 is obtained by arranging the plate portion 161, which is constituted only by the material of the detection subject plate 16, the net portion 162, which serves as the part of the detection subject plate 16 in which the plurality of holes 162*a* are provided, and the opening portion 163, which is constituted entirely by a space, in the movement direction of the car 2 as segments of different types. Therefore, the need to employ a plurality of types of conductors can be eliminated, and as a result, the cost of the material used to form the detection subject body 11 can be reduced. Further, the ID sequence 15 can be provided in the detection subject plate 16 simply by forming the holes 162*a* and the opening portion 163 in the detection subject plate 16, and therefore the detection subject body 11 can be manufactured easily.

Note that in the example described above, the net portion 162 is formed in the detection subject plate 16 as one type of segment, but by varying the density of the holes 162*a* formed in the net portion 162, two or more types of net portions 162 having different magnetic properties can be formed in the detection subject plate 16. In so doing, the number Of different types of segments provided in the ID sequence 15 can be increased easily.

Third Embodiment

Figure 8:
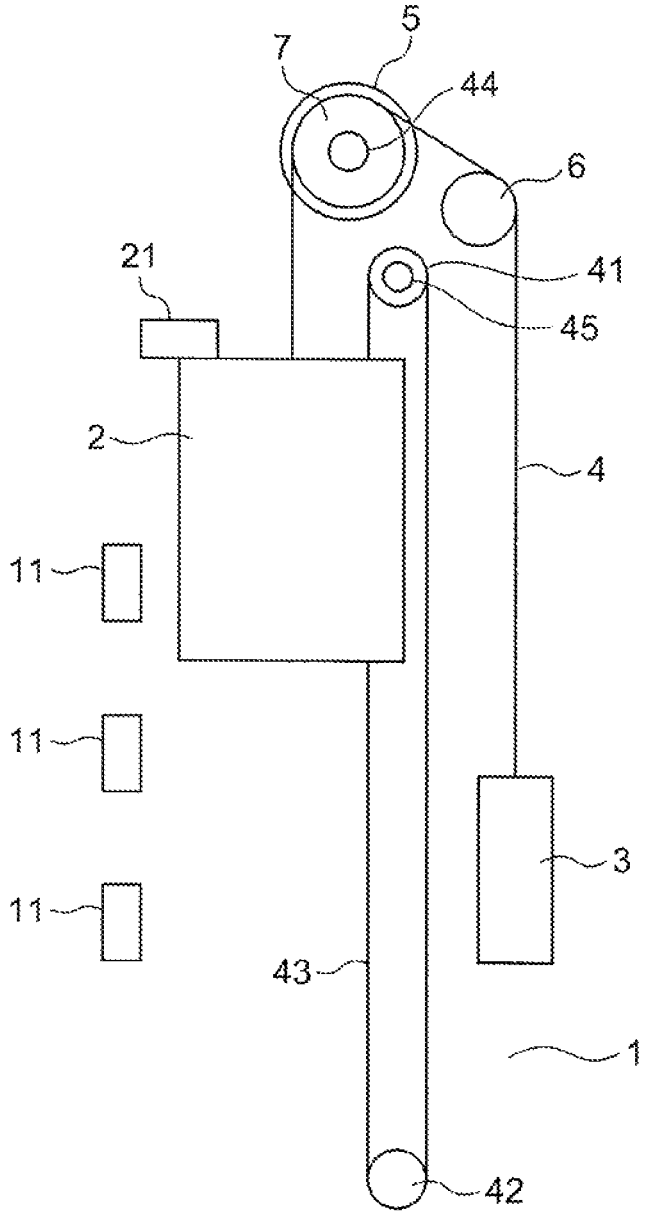
FIG. 8 is a view showing a configuration of an elevator according to a third embodiment of this invention.

FIG. 8 is a view showing a configuration of an elevator according to a third embodiment of this invention. The car 2 and the counter weight 3 are moved through the hoistway 1 in the vertical direction by the driving force of the hoisting machine 5 while being guided individually by a plurality of rails (not shown) disposed in the hoistway 1. The car 2 and the counter weight 3 are moved in accordance with rotation of the drive sheave 7 of the hoisting machine 5.

A safety device (not shown) that forcibly applies braking force to the car 2 by gripping the rails when the speed of the car 2 increases so as to become abnormal is provided on the car 2. A speed governor 41 is provided in an upper portion of the hoistway 1, and a tension pulley 42 is provided in a lower portion of the hoistway 1. A speed governor rope 43 wound in a loop between a speed governor sheave of the speed governor 41 and the tension pulley 42 is connected to an operating lever of the safety device. Hence, the speed governor sheave of the speed governor 41 and the tension pulley 42 rotate in accordance with the movement of the car 2. When the speed of the car 2 increases such that a rotation speed of the speed governor sheave reaches an abnormal speed, the speed governor 41 grips the speed governor rope 43, whereby the operating lever of the safety device is operated. When the operating lever of the safety device is operated, the safety device grips the rails.

The hoisting machine 5 is provided with a hoisting machine encoder (a hoisting machine rotation detector) 44 that generates a signal (a pulse signal) corresponding to the rotation of the drive sheave 7. The speed governor 41 is provided with a speed governor encoder (a speed governor rotation detector) 45 that generates a signal (a pulse signal) corresponding to the rotation of the speed governor sheave. Hence, the hoisting machine encoder 44 and the speed governor encoder 45 both generate signals corresponding to the movement of the car 2.

Figure 9:
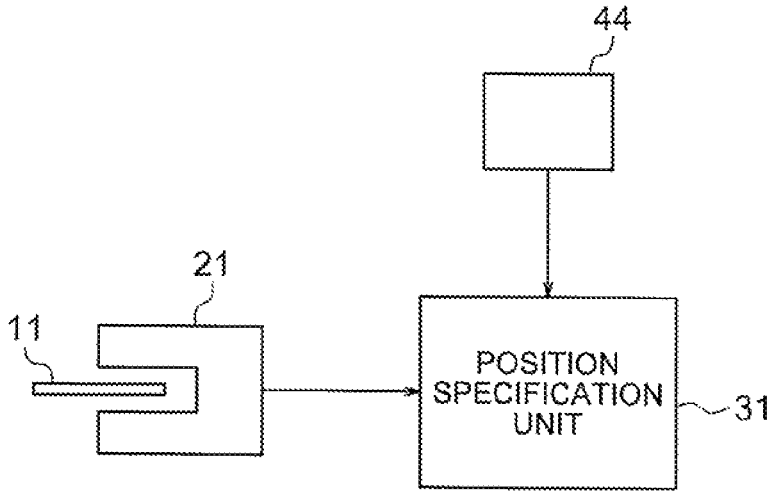
FIG. 9 is a block diagram showing an elevator position detection apparatus shown in FIG. 8.

FIG. 9 is a block diagram showing an elevator position detection apparatus shown in FIG. 8. The signal from the hoisting machine encoder 44 is transmitted to the position specification unit 31 provided in the control apparatus 10. The position specification unit 31 determines the movement direction of the car 2 on the basis of the signal from the hoisting machine encoder 44. Further, the position specification unit 31 specifies the position of the car 2 within the hoistway 1 by processing the digital data from the digital data conversion unit 25 of the detector 21 in accordance with the determined movement direction of the car 2. In other words, the position specification unit 31 specifies the position of the car 2 within the hoistway 1 by rearranging the digital data from the digital data conversion unit 25 in accordance with the movement direction of the car 2. All other configurations are identical to the first embodiment.

In this elevator position detection apparatus, the position specification unit 31 determines the movement direction of the car 2 on the basis of the signal from the hoisting machine encoder 44, and can therefore process the digital data from the digital data conversion unit 25 in accordance with the movement direction of the car 2. Hence, limitations on the arrangement combinations of the ID sequence 15 can be reduced, and as a result, the freedom with which the arrangement combination of the ID sequence 15 is selected can be widened.

Note that in the example described above, the position specification unit 31 determines the movement direction of the car 2 on the basis of the signal from the hoisting machine encoder 44, but the position specification unit 31 may determine the movement direction of the car 2 on the basis of the signal from the speed governor encoder 45. Alternatively, the position specification unit 31 may determine the movement direction of the car 2 on the basis of the respective signals from the hoisting machine encoder 44 and the speed governor encoder 45.

Fourth Embodiment

Figure 10:
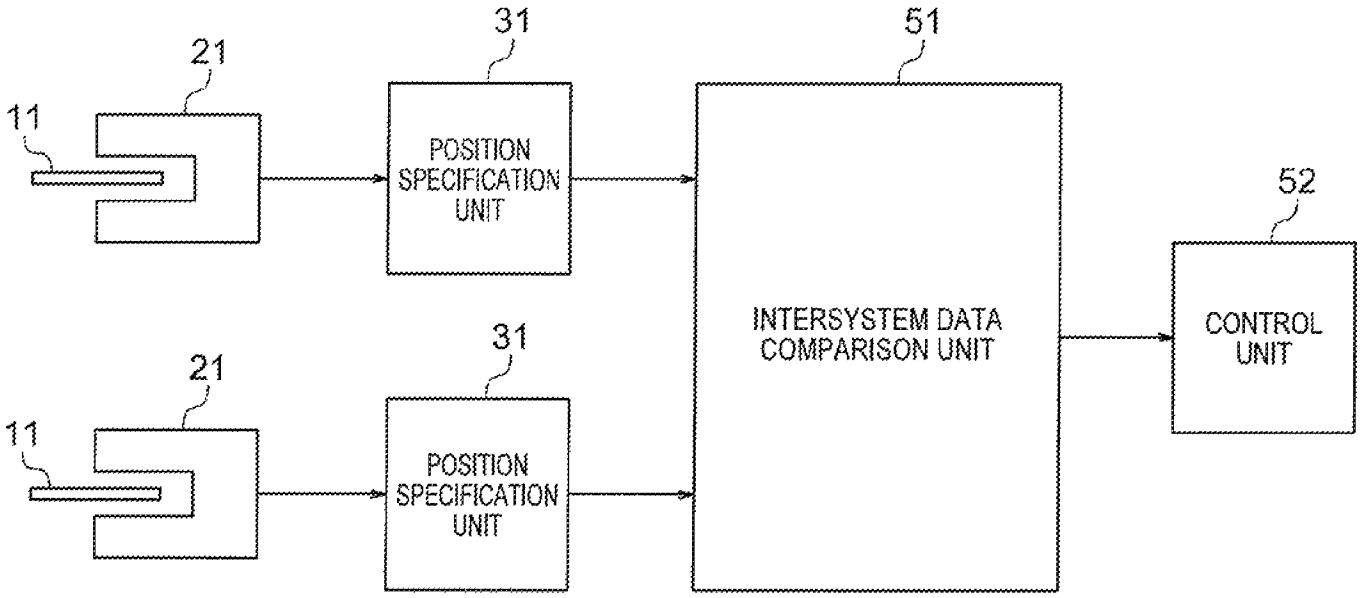
FIG. 10 is a block diagram showing an elevator position detection apparatus according to a fourth embodiment of this invention.

FIG. 10 is a block diagram showing an elevator position detection apparatus according to a fourth embodiment of this invention. A plurality of detection subject bodies 11 (two in this example) are fixed to each reference position in the movement direction of the car 2. The detection subject bodies 11 fixed in a common reference position are disposed, at an interval in the horizontal direction. Further, the segments of the ID sequences 15 provided in the detection subject bodies 11 fixed in a common reference position are arranged in identical arrangement combinations (arrangement patterns). The detection subject bodies 11 are configured identically to the detection subject bodies 11 according to the first embodiment.

The detector 21 is provided on the car 2 in an identical number (two in this example) to the detection subject bodies 11 disposed in a common reference position. The detectors 21 are disposed at an interval in the horizontal direction in alignment with the respective positions of the detection subject bodies 11 disposed in the common reference position. In other words, the detectors 21 correspond individually to the detection subject bodies 11 disposed in the common reference position. The detectors 21 detect the corresponding detection subject bodies 11 individually when the car 2 moves so that the detectors 21 pass through the reference position. Similarly to the first embodiment, when the detectors 21 detect the ID sequences 15 of the detection subject bodies 11, pluralities of digital data corresponding respectively to the detection subject bodies 11 are output from the respective digital data conversion unit 25. The detectors 21 are configured similarly to the detector 21 according to the first embodiment.

The control apparatus 10 is provided with a plurality of position specification units 31 that specify the position of the car 2 individually on the basis of the pluralities of digital data from the respective detectors 21, and an intersystem data comparison unit 51 that processes information received from the respective position specification units 31. The respective position specification units 31 function identically to the position specification unit 31 according to the first embodiment.

The intersystem data comparison unit 51 determines whether or not an abnormality has occurred in the elevator by comparing the plurality of sets of position information (the information indicating the position of the car 2) specified by the respective position specification units 31. More specifically, the intersystem data comparison unit 51 determines that the elevator is normal when the plurality of sets of position information from the respective position specification units 31 match, and determines that the elevator is abnormal when the plurality of sets of position information from the respective position specification units 31 do not match. The intersystem data comparison unit 51 outputs information indicating the result of the determination as to whether or not the elevator is abnormal. Hence, in this example, the processing for specifying the position of the car 2 is duplicated.

The control apparatus 10 includes a control unit 101 that controls the operation of the elevator on the basis of the determination result from the intersystem data comparison unit 51. When the determination result from the intersystem data comparison unit 51 indicates that the elevator is normal, the control unit 101 continues a normal service operation, and when the determination result from the intersystem data comparison unit 51 indicates that the elevator is abnormal, the control unit 101 performs control to stop the car 2 at the nearest floor and then halt the service operation of the elevator. Note that the elevator position detection apparatus includes the plurality of detection subject bodies 11, the plurality of detectors 21, the plurality of position specification units 31, and the intersystem data comparison unit 51. All other configurations are identical to the first embodiment.

In this elevator position detection apparatus, the intersystem data comparison unit 51 determines whether or not an abnormality has occurred in the elevator by comparing the plurality of sets of position information specified by the respective position specification units 31, and therefore an abnormality caused by a fault in the elevator position detection apparatus or the like can be detected, enabling an improvement in the safety of the elevator.

Note that in the example described above, the detection subject body 11, the detector 21, and the position specification unit 31 according to the first embodiment are duplicated, but instead, the detection subject body 11, the detector 21, and the position specification unit 31 according to the second and third embodiments may be duplicated. Further, the detection subject body 11, the detector 21, and the position specification unit 31 are provided respectively in twos, but the respective numbers of the detection subject bodies 11, the detectors 21, and the position specification units 31 may be set at three or more.

The invention claimed is:

1. An elevator position detection apparatus, comprising:

a detection subject body disposed in a hoistway and including an ID sequence formed by arranging three or more types of segments respectively having different magnetic properties in a movement direction of an elevating body, wherein segments having a different magnetic property than a magnetic property of a space within the hoistway are disposed on respective ends of the ID sequence in the movement direction of the elevating body;

an eddy current detector attached to the elevating body to generate signals corresponding to the magnetic properties of the respective segments by applying a magnetic field to the ID sequence while passing through a position of the detection subject body;

identification circuitry configured to identify the respective types of the segments on the basis of the signals from the detector, and output a time series signal corresponding to the ID sequence depending on the type of each segment;

digital data conversion circuitry that converts the time series signal into digital data on the basis of variations of the time series signal from the identification circuitry; and position specification circuitry that specifies a position of the elevating body on the basis of the digital data from the digital data conversion circuitry, wherein the different types of segments forming the ID sequence include different conductivities, and wherein one of the types of the segments disposed so as to avoid the respective ends of the ID sequence is an insulation portion.

2. The elevator position detection apparatus according to claim 1, wherein the insulation portion is a space portion.

3. The elevator position detection apparatus according to claim 1, wherein the insulation portion is an insulating member.

4. The elevator position detection apparatus according to claim 1, wherein:

the ID sequence is disposed on a base material which is a single material, and a part which is an only the material of the base material and a part including a plurality of holes in the base material are disposed on the base material as the different types of segments.

5. The elevator position detection apparatus according to claim 2, wherein:

the ID sequence is disposed on a base material which is a single material, and a part which is an only the material of the base material and a part including a plurality of holes in the base material are disposed on the base material as the different types of segments.

6. The elevator position detection apparatus according to claim 1, wherein the position specification circuitry specifies the position of the elevating body by determining the movement direction of the elevating body on the basis of information from an encoder that generates a signal corresponding to movement of the elevating body, and processes the digital data from the digital data conversion circuitry in accordance with the determined movement direction.

7. The elevator position detection apparatus according to claim 1, further comprising:

a plurality of the detection subject bodies, provided in a common position in the movement direction of the elevating body;

a plurality of detectors that correspond respectively to the detection subject bodies and respectively include the eddy current detector, the identification circuitry, the digital data conversion circuitry, and the position specification circuitry; and intersystem data comparison circuitry that determines whether or not an abnormality has occurred in the elevator by comparing information indicating the position of the elevating body, the information being specified by the respective position specification circuitries of the detectors.

8. The elevator position detection apparatus according to claim 1, further comprising:

a second detection subject body disposed in the hoistway and including a corresponding ID sequence formed by arranging the three or more types of segments respectively having different magnetic properties in a movement direction of an elevating body, wherein segments having a different magnetic property than the magnetic property of the space within the hoistway are disposed on respective ends of the corresponding ID sequence of the second detection subject body in the movement direction of the elevating body, wherein the position specification circuitry identifies which of the ID sequences was identified to indicate a position of the elevating body within the hoistway.

9. An elevator position detection apparatus, comprising:

a plurality of detection subjects disposed in a hoistway and including a corresponding ID sequence having segments having a different magnetic properties, at least two of the plurality of detection subjects including ID sequences which are different from each other;

an eddy current detector attached to an elevating body to generate signals corresponding to the magnetic properties of the respective segments by applying a magnetic field to the ID sequences while passing through positions of the detection subjects;

identification circuitry configured to identify the respective segments on the basis of the signals from the detector, and output a signal corresponding to the respective segments;

digital data conversion circuitry that converts the signal which has been output into digital data on the basis of variations of the signal which has been output; and position specification circuitry that specifies a position of the elevating body on the basis of which of the plurality of detection subjects has been detected.

10. The elevator position detection apparatus according to claim 9, wherein:

the ID sequences of the detection subjects each include three different types of segments.

11. The elevator position detection apparatus according to claim 10, wherein:

the different types of segments forming the ID sequence include different conductivities, and at least one of the types of the segments disposed away from ends of the ID sequences is an insulation portion.

* * * * *